US007866392B2

(12) United States Patent
Rogers et al.

(10) Patent No.: US 7,866,392 B2
(45) Date of Patent: Jan. 11, 2011

(54) METHOD AND APPARATUS FOR SEALING AND CEMENTING A WELLBORE

(75) Inventors: Henry Rogers, Duncan, OK (US); Brett Fears, Duncan, OK (US)

(73) Assignee: Halliburton Energy Services Inc., Duncan, OK (US)

( * ) Notice: Subject to any disclaimer, the term of this patent is extended or adjusted under 35 U.S.C. 154(b) by 267 days.

(21) Appl. No.: 11/954,987

(22) Filed: Dec. 12, 2007

(65) Prior Publication Data

US 2009/0151960 A1 Jun. 18, 2009

(51) Int. Cl.
*E21B 33/13* (2006.01)

(52) U.S. Cl. ..... 166/291; 166/177.4

(58) Field of Classification Search ..... 166/291, 166/154, 177.4, 242.8
See application file for complete search history.

(56) References Cited

U.S. PATENT DOCUMENTS 1,860,669 A 5/1932 Halliburton
2,925,865 A * 2/1960 Oliver ..... 166/154
3,948,322 A * 4/1976 Baker ..... 166/289
4,961,465 A 10/1990 Brandell
2003/0070815 A1 * 4/2003 Sullaway et al. ..... 166/380
2003/0164237 A1 * 9/2003 Butterfield, Jr. ..... 166/291
2007/0272411 A1 * 11/2007 Lopez De Cardenas et al. ..... 166/305.1

OTHER PUBLICATIONS

Halliburton, Packer Shoes, Casing Sales Manual, May 2004, pp. 7-i-7.5-6, Section 7, US.

* cited by examiner

*Primary Examiner*—William P Neuder
*Assistant Examiner*—Catherine Loikith
(74) *Attorney, Agent, or Firm*—John W. Wustenberg; Conley Rose, P.C.

(57) ABSTRACT

A well casing cementing apparatus includes a housing and an inner assembly of movable parts. The housing includes a cementing port and a packer on its outer surface below the cementing port. The inner assembly includes three movable parts comprising a closing sleeve for closing the cementing port after a cementing operation, a closing sleeve seat for moving the closing sleeve and a packer setting sleeve for setting the packer. A rupture disk is provided closing the cementing port in a run in condition and is selected to have a rupture pressure at or above a pressure selected for setting the packer. An expandable collet on a lower end of the housing permits the closing sleeve and the setting sleeve to be pumped out the lower end of the housing, but prevents the pumped out parts from moving back into the housing, e.g. during production of fluids from the well.

19 Claims, 7 Drawing Sheets

METHOD AND APPARATUS FOR SEALING AND CEMENTING A WELLBORE

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

The present invention relates to apparatus and methods for cementing casing in a wellbore.

BACKGROUND OF THE INVENTION

Oil and gas wells must normally be cased from the surface location of the wells down to and sometimes through a producing formation. Casing, e.g. steel pipe, is lowered into the wellbore to a desired depth. The space between the casing and the wellbore, i.e. the annulus, is then typically filled with cement. Once the cement sets in the annulus, it holds the casing in place and prevents flow of fluids to or from or between earth formations through which the well passes, e.g. aquifers.

In some wells it is desirable to complete the well as an open hole completion. Generally, this means that the well is not cased through the producing zone or zones. However, the well would normally still be cased and cemented from the surface location down to a depth just above the producing formation. It is desirable not to fill or contaminate the open hole portion of the well with cement during the cementing process. Formation packer shoes have been used to seal the annulus at the lower end of a casing string and circulate cement up the annulus above the packer. Currently available formation packer shoes normally must be drilled out after the cementing operation to provide access to the producing zone below the casing.

A packer cementing shoe disclosed in U.S. Pat. No. 2,925,865 avoids the need to drill out the apparatus after cementing the annulus. It provides an apparatus which sequentially sets a packer, opens a cementing port with a first valve sleeve, closes the cementing port with a second valve sleeve, and finally pumps part of the apparatus used to perform the previous steps out the lower end of the apparatus and into the open hole.

SUMMARY OF THE INVENTION

A well casing cementing apparatus includes a housing and an inner assembly. The housing includes a cementing port and a packer on its outer surface below the cementing port. The inner assembly includes three movable parts comprising a closing sleeve for closing the cementing port after a cementing operation, a closing sleeve seat for moving the closing sleeve and a packer setting sleeve for setting the packer.

In an embodiment, a rupture disk is provided closing the cementing port in a run in condition. The rupture disk is selected to have a rupture pressure at or above a pressure selected for setting the packer.

In an embodiment, an expandable collet is provided on a lower end of the housing. The collet is expandable to permit the closing sleeve seat and the packer setting sleeve to be pumped out the lower end of the housing, but returns to original dimensions to prevent the pumped out parts from moving back into the housing.

In an embodiment, the housing has an inner surface having essentially constant inner diameter and includes a recess on the inner surface, i.e. an area of increased diameter, in which the closing sleeve is carried and slidable between open and closed positions. The inner diameter of the closing sleeve is about the same as the housing inner diameter and forms part of the housing inner surface.

Disclosed herein is an apparatus for cementing casing in a well, comprising a housing having an upper end adapted for coupling to the lower end of a well casing, the housing having a cementing port extending from an inner surface of the housing to an outer surface of the housing; a packer carried on the housing (e.g., on an outer surface of the housing) below the cementing port; a packer setting sleeve carried within the housing, the packer setting sleeve coupled to the packer and adapted to set the packer in response to a first pressure applied to the packer setting sleeve; a rupture disk carried in the cementing port, the rupture disk blocking flow through the port when it is intact, and selected to rupture at a second pressure, the second pressure being equal to or greater than the first pressure; a closing sleeve carried within the housing (e.g., on an inner surface of the housing) and movable between a first position in which the closing sleeve does not cover the cementing port to a second position in which the closing sleeve covers the cementing port; and a closing sleeve seat carried within the housing, releasably coupled to the closing sleeve, and adapted to move the closing sleeve from the first position to the second position in response to force applied to the closing sleeve seat. The apparatus may further comprise a collet carried on a lower end of the housing. The collet may have an expandable portion having an unexpanded inner diameter smaller than the outer diameter of the packer setting sleeve and the closing sleeve seat, the expandable portion being elastically expandable in response to downward movement of the packer setting sleeve and the closing sleeve seat to permit the packer setting sleeve and the closing sleeve seat to be pumped out of the housing. The packer setting sleeve may include a flow path extending from an upper end to a lower end of the packer setting sleeve whereby fluid may flow through the packer setting sleeve. The apparatus may further comprise a first sealing element adapted to be dropped down the well casing and sized to close the packer setting sleeve flow path, whereby pressure may be selectively applied to the packer setting sleeve. The closing sleeve seat may include a flow path extending from an upper end to a lower end of the closing sleeve seat whereby fluid may flow through the closing sleeve seat. The apparatus may further comprise a second sealing element adapted to be dropped down the well casing and sized to close the closing sleeve seat flow path, whereby force may be selectively applied to the closing sleeve seat by fluid pressure in the well casing. The housing may have a substantially constant inner diameter, except for a recess on its inner surface and the closing sleeve is carried in the recess. The closing sleeve may have an inner diameter about equal to the cylindrical housing inner diameter. The second pressure may be selected to be equal to the first pressure, whereby the second pressure establishes the pressure which sets the packer.

Disclosed herein is an apparatus for cementing casing in a well, comprising a housing having an upper end adapted for coupling to the lower end of a well casing, the housing having a cementing port extending from an inner surface of the housing to an outer surface of the housing; a closing sleeve carried within the housing and movable between a first position in which the closing sleeve does not cover the cementing port to a second position in which the closing sleeve covers the cementing port; a closing sleeve seat carried within the housing, releasably coupled to the closing sleeve, and adapted to selectively move the closing sleeve from the first position to the second position; a packer carried on the housing below the cementing port; a packer setting sleeve carried within the housing, the packer setting sleeve coupled to the packer and adapted to selectively set the packer; and a collet carried on a lower end of the housing. The collet may have an expandable portion having an unexpanded inner diameter smaller than the outer diameter of the packer setting sleeve and the closing sleeve seat, the expandable portion being elastically expandable in response to downward movement of the packer setting sleeve and the closing sleeve seat thereby permitting the packer setting sleeve and the closing sleeve seat to be pumped out of the housing. The packer setting sleeve may be adapted to set the packer in response to a first pressure applied to the packer setting sleeve. The apparatus may further comprise a rupture disk carried in the cementing port, the rupture disk blocking flow through the port when it is intact and selected to rupture at a second pressure, the second pressure being at least as great as the first pressure. The cylindrical housing may have a substantially constant inner diameter, except for a recess on its inner surface, and the closing sleeve is carried in the recess. The closing sleeve may have an inner diameter about equal to the cylindrical housing inner diameter.

Disclosed herein is an apparatus for cementing casing in a well, comprising a housing having a cementing port extending from an inner surface of the housing to an outer surface of the housing; a packer carried on the housing below the cementing port; an inner assembly carried within the housing consisting of three movable parts as assembled for running into the well. The three movable parts comprise a closing sleeve carried within the housing and movable between a first position in which the closing sleeve does not cover the cementing port to a second position in which the closing sleeve covers the cementing port; a closing sleeve seat carried within the housing, releasably coupled to the closing sleeve, and adapted to move the closing sleeve from the first position to the second position; and a packer setting sleeve carried within the housing below the closing sleeve, the packer setting sleeve coupled to the packer and adapted to selectively set the packer. The closing sleeve seat and packer setting sleeve are adapted to be pumped out of the cylindrical housing leaving only one movable part within the housing. The apparatus may further comprise a collet carried on a lower end of the housing, the collet having an expandable portion having an unexpanded inner diameter smaller than the outer diameter of the packer setting sleeve and the closing sleeve seat, the expandable portion being elastically expandable in response to downward movement of the packer setting sleeve and the closing sleeve seat thereby permitting the packer setting sleeve and the closing sleeve seat to be pumped out of the housing, and preventing the packer setting sleeve and the closing sleeve seat from moving back into the housing. The collet may comprise a plurality of axial slots selected to permit production of fluids through the slots.

Disclosed herein is an apparatus for cementing casing in a well, comprising a housing having an upper end adapted to couple to a lower end of a well casing, the housing having a cementing port extending from an inner surface of the housing to an outer surface of the housing; a rupture disk carried in the cementing port, the rupture disk blocking flow through the port when it is intact, and a slotted, elastically expandable collet coupled to a lower end of the housing. The collet may comprise a plurality of axial slots sized to permit production of fluids through the slots.

A method of servicing a well, comprising coupling a cementing apparatus to the lower end of a casing string, the cementing apparatus comprising a cementing port, a rupture disk in the cementing port, a cementing port closing sleeve, a cementing port closing seat, a packer, and a packer setting sleeve; running the cementing apparatus and casing string into a well; applying pressure through the casing string to the packer setting sleeve and thereby setting the packer; and applying pressure through the casing string to the rupture disk and thereby rupturing the rupture disk. The method may further comprise flowing cement through the cementing port; applying pressure through the casing string to the closing sleeve seat and thereby moving the closing sleeve and closing the cementing port; and applying pressure through the casing string to the closing sleeve and thereby pumping the closing sleeve and packer setting sleeve out of a lower end of the cementing apparatus. The method may further comprise attaching an expandable collet to the lower end of the housing, the collet having an unexpanded inner diameter less than an outer diameter of the closing sleeve and the packer setting sleeve, expanding the collet to have an inner diameter at least as large as the outer diameter of the closing sleeve and the packer setting sleeve, and pumping the closing sleeve and packer setting sleeve through the collet and into the well. The method may further comprise applying pressure through the casing string to the rupture disk and to the packer setting sleeve at the same time, and selecting a rupture disk rupture pressure which is sufficient to set the packer.

A method servicing a well, comprising coupling a cementing apparatus to the lower end of a well casing, the cementing apparatus comprising a housing, an inner assembly of movable parts carried in the housing, and an expandable collet carried on a lower end of the housing; running the cementing apparatus and casing into a well; flowing cement through the cementing apparatus and into an annulus between the casing the well; expanding the collet to provide an inner diameter large enough to permit at least one movable part of the inner assembly to pass through the collet; and pumping at least one movable part of the inner assembly out of the housing and through the collet and into the well. The method may further comprise contracting the collet to provide an inner diameter too small to permit the at least one movable part from moving through the collet, and flowing fluids from the well through the housing. The collet may comprise a plurality of axial slots and the fluids flow from the well through the axial slots and housing.

Disclosed herein is a method of servicing a well, comprising rupturing a disk disposed in a cementing port positioned near a terminal end of a casing string; and flowing cement through the port. The method may further comprise pumping a cement wiper plug down the casing; engaging a slideable sleeve with the wiper plug; moving the slideable sleeve to close the cementing port; and pumping the wiper plug out the terminal end of the casing. The pumping the wiper plug out the terminal end of the casing may further comprise expanding a collet coupled to a lower end of the casing string; passing the wiper plug through the collet; and contracting the collet to prevent the wiper plug from reentering the casing from the well. The method may further comprise producing fluids from the well by flowing the fluids through the collet.

DETAILED DESCRIPTION OF THE PREFERRED EMBODIMENTS

In the present disclosure, a first element may be described as upper, above, or uphole relative to a second element, which second element may be described as lower, below or downhole relative to the first element. The top of a well is at the surface of the Earth, which may be below water in a sub-sea well, and the bottom is the end of the well opposite the top, even though the bottom may not be directly below the top and may be horizontally displaced by a substantial distance. Portions of a well may be slanted or even horizontal. In a horizontal well, the first element would still be referred to as uphole or above the second element because it is closer to the surface end of the well.

As discussed above, formation packer shoes of the pump out type are known for cementing casing. As used herein, the term pump out means that at least a part of the apparatus can be forced out the bottom of the apparatus by application of pressure through well casing to which the apparatus is attached. Pump out formation packer shoes normally avoid the need to drill out the apparatus and/or cement to provide a flow path from the casing to a producing formation. However, the prior art systems are relatively complicated, e.g. have multiple sleeve valves and shear pins. Such systems are normally made of material that may be drilled out in case the system fails to function as desired. Even if they function as intended, the systems often leave a portion of the apparatus in the formation packer shoe which obstructs the flow path to some extent and/or produces a non-uniform flow path. In addition, a portion of the apparatus that has been pumped out, or the whole pumped out portion, has in some wells been transported by produced fluids back up to or into the casing and interfered with production. The present invention provides a simplified system which avoids such problems while providing the benefits of a pump out formation packer shoe in a well casing cementing system.

Figure 1:
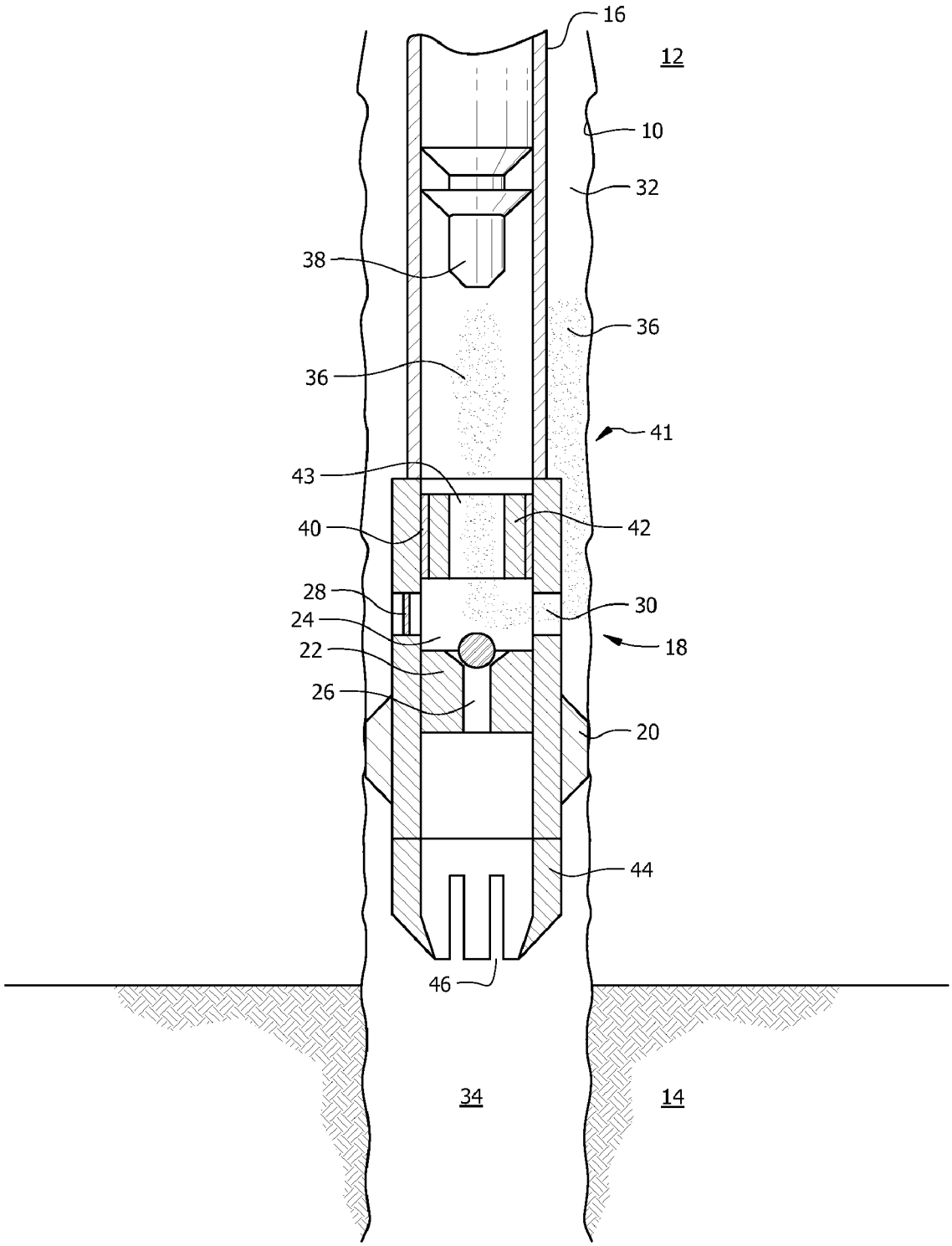
FIG. 1 is a generalized illustration of a wellbore and a cementing apparatus according to the present invention.

With reference to FIG. 1, the general structure and use of the present invention will be described. A wellbore 10 is shown extending through upper Earth formations 12 and a lower productive Earth formation 14. In this embodiment, it is desired to case the wellbore 10 through the upper formations 12, but to leave the wellbore 10 in the open hole condition in the productive formation 14. A casing 16 has been lowered down the wellbore 10 through the upper formations 12, but stopped before entering the productive formation 14.

Attached to the lower end of the casing 16 is a cementing apparatus 18 according to the present invention. The apparatus 18 includes an external packer element 20 shown in its deployed condition in which it seals the annulus 32 between the apparatus 18 and the wellbore 10. The packer element 20 has been deployed by application of fluid pressure in the casing 16 to a packer setting sleeve 22 and ball 24. The ball 24 has been dropped or pumped down the casing 16 when it was desired to deploy the packer element 20. Before the ball 24 was positioned on the setting sleeve 22, fluid could be circulated in the well through a flow path 26 through the setting sleeve 22. It is normally desirable to circulate fluid to displace drilling fluid and filter cake from the annulus 32 before circulating cement into the annulus 32.

After the ball 24 was set on the setting sleeve 22, pressure in the casing 16 was increased to drive the sleeve 22 down and set the packer element 20. Then the pressure in the casing 16 was further increased to break a rupture disk 28 in a port 30. Once the port 30 is opened, fluid may be circulated down the casing 16 and back up an annulus 32 between the casing 16 and borehole 10 above packer element 20. The packer element 20 and the ball 24 prevent the fluid from flowing into the open hole portion 34 of the wellbore 10. It is not necessary that the pressure in the casing 16 be increased in steps. The rupture pressure of disk 28 may be selected to be at least as great as a pressure needed to properly set the packer 20. The pressure may simply be increased until the rupture disk ruptures, since the packer setting pressure will be reached by the time the disk 28 ruptures. One feature of the present embodiments is that selection of the rupture disk rupturing pressure establishes the pressure which is applied to the sleeve 22 to set the packer 20 and therefore establishes the force used to set the packer 20.

A quantity of cement 36 is shown flowing down the casing 16, out the port 30 and up the annulus 32. The cement 36 is followed by a top wiper plug 38. The plug 38 separates the cement 36 from other borehole fluid used to drive the cement 36 down the casing 16 and wipes the inner surface of the casing 16. The wiper plug 38 is also adapted to engage a closing sleeve assembly 41 positioned above the port 30 after the desired quantity of cement 36 has been pumped into the annulus 32. The assembly 41 includes a closing sleeve or valve 40 and a closing sleeve seat 42. A flow path 43 is provided through the assembly 41 to allow fluid circulation. The wiper plug 38 engages the closing sleeve seat 42 to block the flow path 43 and allow fluid pressure to be applied to the assembly 41. The pressure in casing 16 is again increased to drive the plug 38 and closing sleeve assembly 41 down, so that the closing sleeve 40 closes the port 30. With a further pressure increase, the plug 38 and closing sleeve seat 42 move further down until they contact the packer setting sleeve 22. The plug 38, closing sleeve seat 42, ball 24 and setting sleeve 22 move together down through a collet 44 on the lower end of the apparatus 18 and drop into the open hole portion 34 of the wellbore 10. The collet 44 has axial slots 46 which allow it to expand to an increased inner diameter and allow the plug 38, closing sleeve seat 42, ball 24 and setting sleeve 22 to move out of the apparatus 18. After these parts are pumped out, the collet 44 springs back, i.e. contracts, to its original size to prevent the various elements from moving back into the casing 16 when fluids are produced from the formation 14 and up the casing 16. If any of the elements move back into contact with the collet 44, fluids may be produced through the slots 46. The slots 46 may be sized to provide a flow path which provides minimal pressure drop for produced fluids.

FIGS. 2-7 are detailed illustrations of one embodiment of cementing apparatus 18 from run in condition through pumped out condition. Reference numbers used in FIG. 1 are used to identify corresponding parts in this embodiment.

Figure 2:
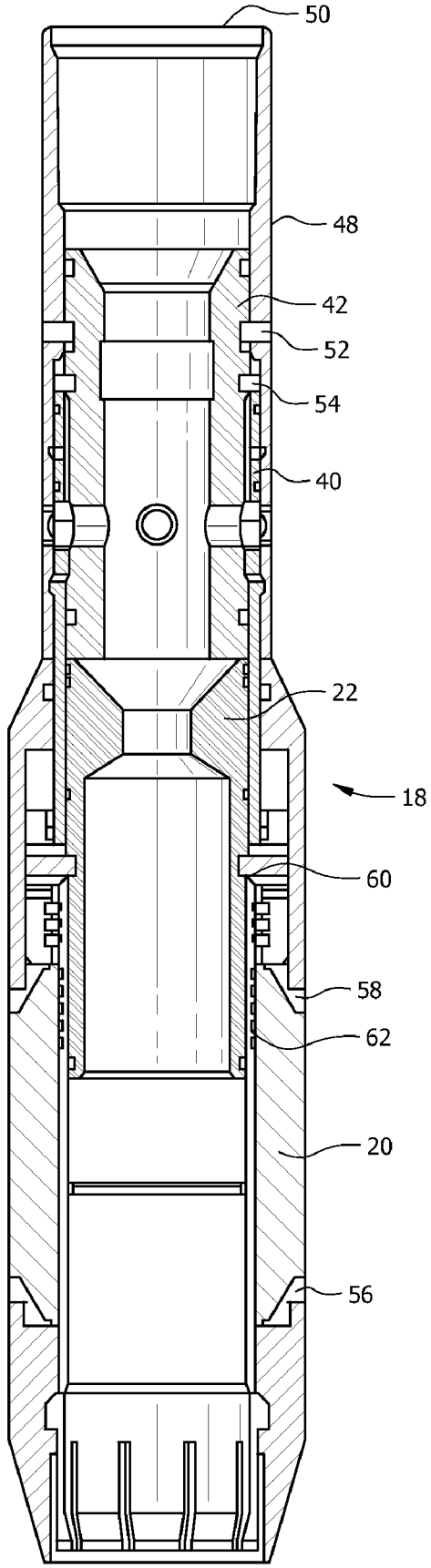
FIG. 2 is a more detailed illustration of a cementing apparatus according to one embodiment in its run in condition.

FIG. 2 is an illustration of cementing apparatus 18 in its run in condition. That is, the apparatus 18 is shown as assembled at the surface, attached to the lower end of a string of casing 16 and lowered to a desired deployment position in a well 10. The apparatus 18 includes an outer structural member or housing 48 having an upper end 50 adapted, e.g. internally threaded, for connection to the lower end of a casing string 16. Carried within an upper end of the housing 48 is the closing sleeve seat 42 and the closing sleeve 40. Shear pins 52 engage the housing 48 and the closing sleeve seat 42 to hold closing sleeve seat 42 in the run in condition. Shear pins 54 engage the closing sleeve seat 42 and the closing sleeve 40 to hold the closing sleeve 40 in its run in condition.

The packer element 20 is carried on an outer surface of a lower portion of housing 48. A lower packer retainer 56 is fixed to the housing 48 below the element 20. An upper packer retainer 58 is slidably carried on the housing 48 above the element 20. Shear pins 60 engage the upper packer retainer 58 and the packer setting sleeve 22 and hold the setting sleeve 22 in its run in condition. Ratchet teeth 62 are provided between the upper retainer 58 and the housing 48 to both hold the retainer 58 in its run in position and to later lock it into its packer setting position when sufficient force is applied to set the packer 20.

Figure 3:
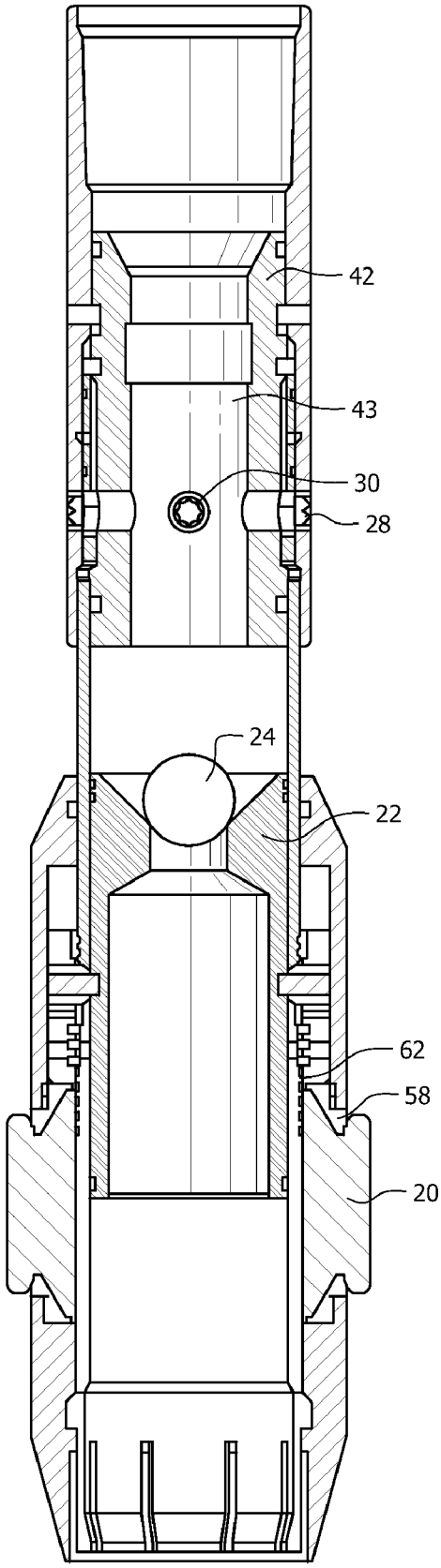
FIG. 3 is an illustration of the FIG. 2 embodiment in its packer setting condition.

In FIG. 3, the packer setting ball 24 has been dropped through the closing sleeve seat 42 flow path 43 and landed on the setting sleeve 22. Fluid pressure in the casing 16 has been increased sufficiently to drive the packer setting sleeve 24 downward with sufficient force to move packer retainer 58 downward to axially compress packer element 20 and radially expand element 20 into contact with the borehole 10 as shown in FIG. 1. The force also overcomes the resistance of the ratchet teeth 62 and locks the teeth 62 together to maintain the force on the packer element 20 so that it remains in its set state.

In FIG. 3, the pressure in casing 16 has been increased sufficiently to rupture one or more of the rupture disks 28 and thereby open one or more ports 30. The rupture disks are selected to have a rupture pressure at or above the minimum pressure needed to properly deploy the packer element 20. That is, the rupture disks 28 may be used, in part, to establish packer setting pressure. Once at least one rupture disk 28 has ruptured and opened one or more ports 30, fluid circulation is allowed down the casing 16 through the closing seat flow path 43 and ports 30 and up the annulus 32 above the packer 20.

Figure 4:
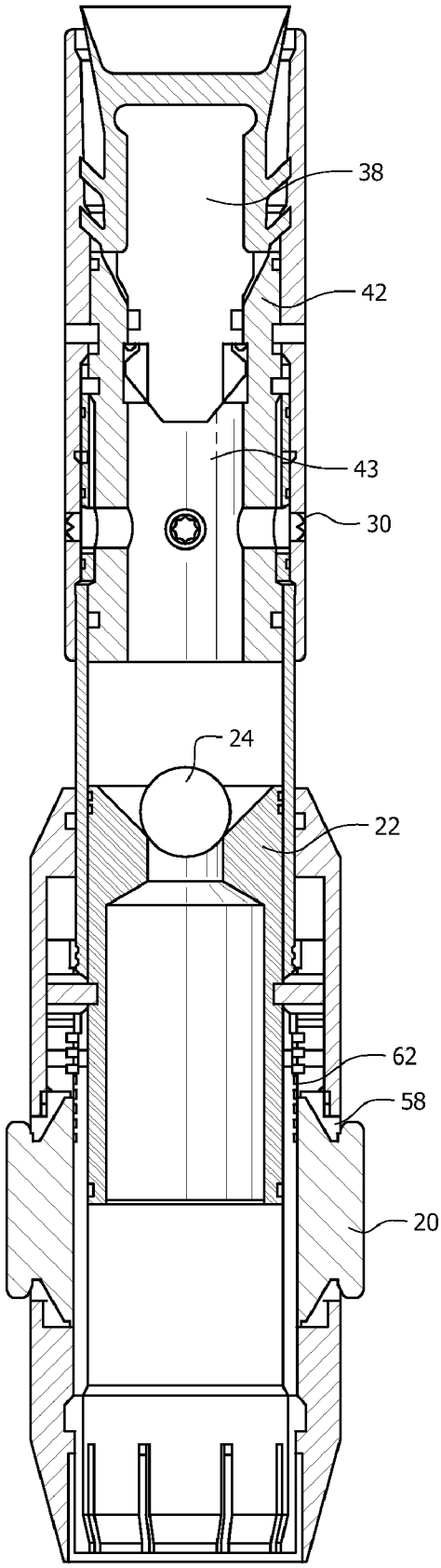
FIG. 4 is an illustration of the FIG. 2 embodiment at the end of a cementing operation.

In FIG. 4, the cementing plug 38 has been pumped down the casing 16 above the cement 36 and has landed on the closing sleeve seat 42. The plug 38 prevents further circulation of fluid through the flow path 43 in closing sleeve seat 42 and therefore allows fluid pressure to be applied to the closing sleeve seat 42. As shown in FIG. 1, the cement 36 has been pumped out ports 30 and up the annulus 32.

Figure 5:
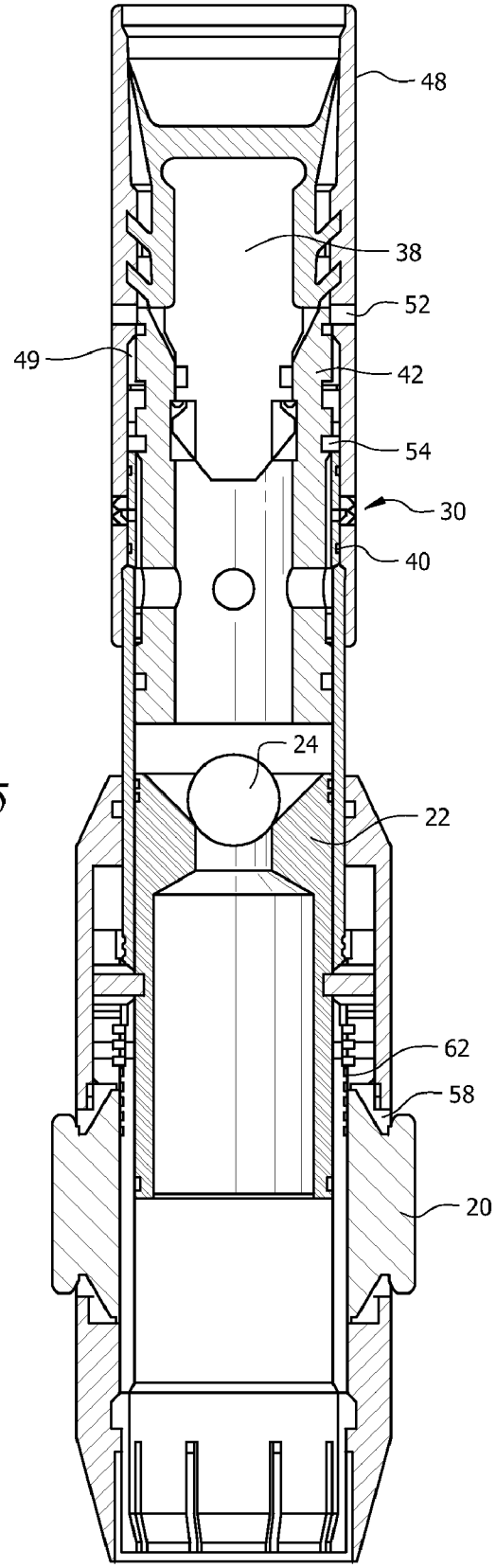
FIG. 5 is an illustration of the FIG. 2 embodiment at the end of a sleeve closing operation.

In FIG. 5, pressure has been increased in the casing 16 to apply downward force to the plug 38 and the closing sleeve seat 42. The pressure has been increased sufficiently to shear the shear pins 52 and thereby allow the closing sleeve seat 42 to move downward within the housing 48. The shear pins 54 remain intact and therefore the closing sleeve 40 has moved down with the closing sleeve seat 42. The closing sleeve 40 has moved to its lowermost position and covered, i.e. closed, the ports 30 to prevent any further circulation or reverse circulation through the ports 30.

The housing 48 includes a recess or enlarged inner diameter portion 49 within which the closing sleeve 40 may move from an upper position, its run in position, at which it does not block ports 30 to a lower position at which it does block ports 30. The inner diameter of closing sleeve 40 preferably is the same as the inner diameter of the remaining portions of housing 48 to provide an essentially constant inner diameter throughout the length of housing 48, i.e. the closing sleeve 40 does not interfere with movement of fluids or well tools through the cementing apparatus 18.

Figure 6:
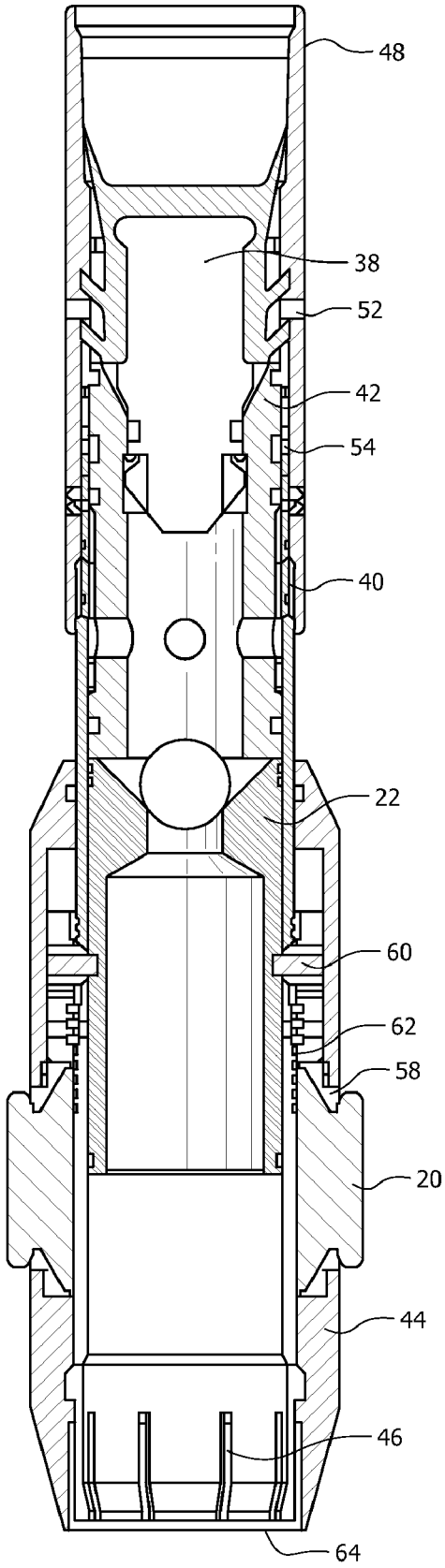
FIG. 6 is an illustration of the FIG. 2 embodiment in a pump out position.

In FIG. 6, the pressure in casing 16 has sheared the shear pins 54, thereby releasing the coupling between the closing sleeve seat 42 and the closing sleeve 40. Note that the pressure in casing 16 does not necessarily need to be increased to shear the pins 54. When shear pins 52 are sheared, relatively little force is needed to move the closing sleeve 40 downward. When sleeve 40 reaches its lowermost position and stops, the pressure used to shear pins 52 may be sufficient to shear the pins 54.

As shown in FIG. 6, after the shear pins 52 and 54 are sheared, the closing sleeve seat 42 continues to move downward into contact with the packer setting sleeve 22. Pressure in the casing 16 is then applied through plug 38, closing sleeve seat 42, and the setting sleeve 22 to shear the shear pins 60, thereby releasing the packer setting sleeve 22 from its coupling to the upper packer retainer 58. The pressure used to shear shear pins 52 may be sufficient to shear the shear pins 60. Once all the shear pins 52, 54 and 60 have been sheared, the assembly of plug 38, closing sleeve seat 42, and setting sleeve 22 may move down together within the housing 48.

As shown in FIG. 1, the inner surface of the lower end 64 of collet 44 tapers down to a smaller diameter than the outer diameter of plug 38, closing sleeve seat 42, and packer setting sleeve 22. When the packer setting sleeve 22 reaches the lower end of the collet 44, the slots 46 allow the collet to spring open sufficiently to allow the packer setting sleeve 22 and the following parts, i.e. closing sleeve seat 42 and plug 38 to pass out the bottom of the collet 44. The expansion of collet 44 is essentially elastic so that it returns to its original dimensions once the inner parts have been pumped out of the cementing apparatus 18.

Figure 7:
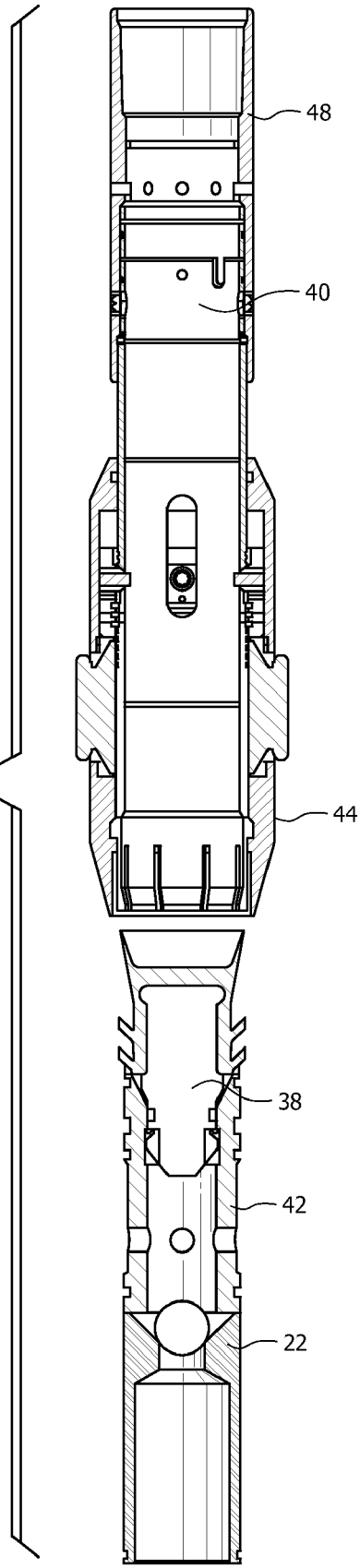
FIG. 7 is an illustration of the FIG. 2 embodiment after internal parts have been pumped out.

FIG. 7 illustrates plug 38, closing sleeve seat 42, and setting sleeve 22 having passed through and out the bottom of the collet 44. Once these elements are below the collet 44, the collet springs back to its original size. Fluids produced from formation 14 flow up through the collet 44. It is possible that the fluids might lift one or more of plug 38, closing sleeve seat 42, and setting sleeve 22 back up to the collet 44. Since the collet 44 has returned to its original inner diameter, the plug 38, etc. will not fit back into the collet 44 and housing 48. If the plug 38 covers the lower end of collet 44, the slots 46 are sized to permit production of fluids through the slots 46.

FIG. 7 also illustrates the smooth full diameter inner bore of the housing 48 after the inner elements, i.e. plug 38, closing sleeve seat 42, and setting sleeve 22, have been pumped out the bottom of the housing 48. The only moving part of the assembly 18 that remains on or forms part of the inner surface of housing 48 is the closing sleeve 40 which has an inner diameter substantially the same as the casing 16 and other portions of housing 48. As a result, oilfield tools, e.g. logging tools, may be lowered through the casing 16 and the housing 48 to the producing formation 14 without any restriction or obstruction.

In the above description of FIGS. 4-7, various steps in operation of the system 18 have been described as occurring as a result of applying or increasing fluid pressure through the casing 16. The pressure is applied by pumping fluid through the casing 16. In practice, the steps that occur after the plug 38 lands in the closing sleeve seat 42 may be performed by continuous pumping of fluid into the casing 16. As the fluid is pumped, the various parts will move and shear pins will shear at the appropriate times as the pressure builds in response to pumping fluid into the casing 16. Fluid pressure may be monitored to confirm the occurrence of each of the steps described above. For example, pressure will increase as force is applied to shear pins 52 and will drop when the shear pins 52 shear and allow the closing sleeve seat 42 to move.

In this embodiment, the cementing apparatus 18 in its run in condition has only three internal moving parts, the closing sleeve 40, the closing sleeve seat 42 and the packer setting sleeve 22. After the cementing operation, the closing sleeve seat 42 and setting sleeve 22 are pumped out of the housing 48. Thus, only one of the original internal moving parts, i.e. the closing sleeve 40 remains in the housing 48 during production. The closing sleeve 40 inner diameter is essentially the same as the inner diameter of the rest of the housing 48, so that in production condition, the apparatus 18 has an essentially constant inner diameter which does not interfere with flow of produced fluids or movement of oilfield tools through the apparatus 18.

While the present embodiments have been described with reference to particular structures and methods of operation, it is apparent that various equivalent elements may be substituted and methods may be modified within the scope of the present invention as defined by the appended claims.

What we claim as our invention is:

1. An apparatus for cementing casing in a well, comprising:

a housing having an upper end adapted to couple to a lower end of a well casing, the housing having a cementing port extending radially from an inner surface of the housing to an outer surface of the housing, a packer carried on an outer surface of the housing below the cementing port, a packer setting sleeve carried within the housing, the packer setting sleeve coupled to the packer and adapted to set the packer in response to a first pressure applied to the packer setting sleeve, a rupture disk carried in the cementing port, the rupture disk blocking flow through the port when it is intact, and selected to rupture at a second pressure, the second pressure being equal to or greater than the first pressure, a closing sleeve carried within the housing and movable between a first position in which the closing sleeve does not cover the cementing port to a second position in which the closing sleeve covers the cementing port, and a closing sleeve seat carried within the housing, releasably coupled to the closing sleeve, and adapted to move the closing sleeve from the first position to the second position in response to force applied to the closing sleeve seat; and a collet coupled to a lower end of the housing the collet having an expandable portion having an unexpanded inner diameter smaller than the outer diameter of the packer setting sleeve and the closing sleeve seat, the expandable portion being elastically expandable in response to downward movement of the packer setting sleeve and the closing sleeve seat to permit the packer setting sleeve and the closing sleeve seat to be pumped out of the housing, and the collet comprising an outer diameter greater than an inner diameter of the well casing.

2. The apparatus of claim 1, wherein;

the packer setting sleeve includes a flow path extending from an upper end to a lower end of the packer setting sleeve whereby fluid may flow through the packer setting sleeve, and further comprising;

a first sealing element adapted to be dropped down the well casing and sized to close the packer setting sleeve flow path, whereby force may be selectively applied to the packer setting sleeve by fluid pressure in the well casing.

3. The apparatus of claim 1, wherein;

the closing sleeve seat includes a flow path extending from an upper end to a lower end of the closing sleeve seat whereby fluid may flow through the closing sleeve seat, further comprising;

a second sealing element adapted to be dropped down the well casing and sized to close the closing sleeve seat flow path, whereby force may be selectively applied to the closing sleeve seat by fluid pressure in the well casing.

4. The apparatus of claim 1, wherein;

the closing sleeve is carried in a recess on the inner surface of the housing, the inner diameter of the closing sleeve is about equal to the inner diameter of the housing such that the apparatus has a substantially constant inner diameter, and the inner diameter of the housing is about equal to an inner diameter of the casing.

5. An apparatus for cementing casing in a well, comprising:

a housing having an upper end adapted to couple to the lower end of a well casing, the housing having a cementing port extending radially from an inner surface of the housing to an outer surface of the housing, a closing sleeve carried within the housing and movable between a first position in which the closing sleeve does not cover the cementing port to a second position in which the closing sleeve covers the cementing port, a closing sleeve seat carried within the housing, releasably coupled to the closing sleeve, and adapted to selectively move the closing sleeve from the first position to the second position, a packer carried on an outer surface of the housing below the cementing port, a packer setting sleeve carried within the housing, the packer setting sleeve coupled to the packer and adapted to selectively set the packer, and a collet coupled to a lower end of the housing, the collet having an expandable portion having an unexpanded inner diameter smaller than the outer diameter of the packer setting sleeve and the closing sleeve seat, the expandable portion being elastically expandable in response to downward movement of the packer setting sleeve and the closing sleeve seat to permit the packer setting sleeve and the closing sleeve seat to be pumped out of the housing, and the collet comprising an outer diameter greater than an inner diameter of the well casing.

6. The apparatus of claim 5, wherein:

the packer setting sleeve is adapted to set the packer in response to a first pressure applied to the packer setting sleeve, and further comprising:

a rupture disk carried in the cementing port, the rupture disk blocking flow through the port when it is intact, and selected to rupture at a second pressure, the second pressure being equal to or greater than the first pressure.

7. The apparatus of claim 5, wherein;

the closing sleeve is carried in a recess on the inner surface of the housing, the inner diameter of the closing sleeve is about equal to the inner diameter of the housing such that the apparatus has a substantially constant inner diameter, and the inner diameter of the closing sleeve is about equal to the inner diameter of the well casing.

8. The apparatus of claim 5, wherein the collet comprises a plurality of axial slots sized to permit production of fluids through the slots.

9. An apparatus for cementing casing in a well, comprising:

a housing having an upper end adapted to couple to a lower end of a well casing, the housing having a cementing port extending radially from an inner surface of the housing to an outer surface of the housing, a packer carried on the outer surface of the housing below the cementing port, an inner assembly carried within the housing consisting of three movable parts as assembled for running into the well, the three movable parts comprising;

a closing sleeve carried within the housing and movable between a first position in which the closing sleeve does not cover the cementing port to a second position in which the closing sleeve covers the cementing port, a closing sleeve seat carried within the housing, releasably coupled to the closing sleeve, and adapted to move the closing sleeve from the first position to the second position, and a packer setting sleeve carried within the housing below the closing sleeve, the packer setting sleeve coupled to the packer and adapted to selectively set the packer, wherein the closing sleeve seat and packer setting sleeve are adapted to be pumped out of the cylindrical housing leaving only one movable part within the housing; and wherein the closing sleeve is carried in a recess on the inner surface of the housing, and the inner diameter of the closing sleeve is about equal to the inner diameter of the housing such that the apparatus has a substantially constant inner diameter.

10. The apparatus of claim 9, further comprising:

a collet coupled to a lower end of the housing, the collet having an expandable portion having an unexpanded inner diameter smaller than the outer diameter of the packer setting sleeve and the closing sleeve seat, the expandable portion being elastically expandable in response to downward movement of the packer setting sleeve and the closing sleeve seat thereby permitting the packer setting sleeve and the closing sleeve seat to be pumped out of the housing, but preventing the packer setting sleeve and the closing sleeve seat from moving back into the housing.

11. The apparatus of claim 10, wherein the collet comprises a plurality of axial slots sized to permit production of fluids through the slots.

12. An apparatus for cementing casing in a well, comprising:

a housing having an upper end adapted to couple to a lower end of a well casing, the housing having a cementing port extending radially from an inner surface of the housing to an outer surface of the housing, a rupture disk carried in the cementing port, the rupture disk blocking flow through the port when it is intact, and a slotted, elastically expandable collet coupled to a lower end of the housing;

wherein the collet comprises an outer diameter greater than an inner diameter of the well casing and wherein the collet has an expandable portion having an unexpanded inner diameter smaller than an inner diameter of the inner surface of the housing.

13. The apparatus of claim 12, wherein the collet comprises a plurality of axial slots sized to permit production of fluids through the slots.

14. A method of servicing a well, comprising:

coupling a cementing apparatus to the lower end of a casing string, the cementing apparatus comprising a radial cementing port, a rupture disk in the radial cementing port, a cementing port closing sleeve, a cementing port closing seat, a packer, a packer setting sleeve, and an expandable collet attached to a lower end of a housing of the apparatus, the collet having an outer diameter greater than an inner diameter of the casing string and an unexpanded inner diameter less than an outer diameter of the closing sleeve and the packer setting sleeve, running the cementing apparatus and casing string into a well, applying pressure through the casing string to the packer setting sleeve and thereby setting the packer, applying pressure through the casing string to the rupture disk and thereby rupturing the rupture disk;

flowing cement through the radial cementing port, applying pressure through the casing string to the closing sleeve seat and thereby moving the closing sleeve and closing the radial cementing port;

applying pressure through the casing string to the closing sleeve and thereby pumping the closing sleeve, packer setting sleeve, and a wiper plug out of a lower end of the cementing apparatus by expanding the collet to have an inner diameter equal to or greater than the outer diameter of the closing sleeve, the packer setting sleeve, and the wiper plug; and contracting the collet to prevent the closing sleeve the sacker setting sleeve and the wiper plug from reentering the casing string from the well.

15. A method of servicing a well, comprising:

coupling a cementing apparatus to the lower end of a well casing, the cementing apparatus comprising a housing, an inner assembly of movable parts carried in the housing, and an expandable collet carried on a lower end of the housing, the expandable collet comprising an outer diameter greater than an inner diameter of the well casing, running the cementing apparatus and casing into a well, flowing cement through the cementing apparatus and into an annulus between the casing the well, expanding the collet to provide an inner diameter of the collet large enough to permit at least one movable part of the inner assembly to pass through the collet, and pumping at least one movable part of the inner assembly out of the housing through the collet and into the well.

16. The method of claim 15, further comprising:

contracting the collet to prevent the at least one movable part from reentering the housing from the well, and flowing fluids from the well through the housing.

17. The method of claim 16, wherein the collet comprises a plurality of axial slots and the fluids flow from the well through the axial slots and housing.

18. A method of servicing a well, comprising:

rupturing a disk disposed in a radial cementing port positioned near a terminal end of a casing string;

flowing cement through the radial cementing port;

pumping a cement wiper plug down the casing;

engaging a slideable sleeve with the wiper plug;

moving the slideable sleeve to close the radial cementing port; and pumping the wiper plug out the terminal end of the casing, wherein pumping the wiper plug out the terminal end of the casing further comprises:

expanding a collet coupled to a lower end of the casing string;

passing the wiper plug through the collet; and contracting the collet to prevent the wiper plug from reentering the casing from the well;

wherein the collet comprises an outer diameter greater than an inner diameter of the casing string.

19. The method of claim 18, further comprising producing fluids from the well by flowing the fluids through the collet.

* * * * *